US007552679B2

(12) United States Patent
Koike

(10) Patent No.: US 7,552,679 B2
(45) Date of Patent: Jun. 30, 2009

(54) PRINTER

(75) Inventor: Yoshikazu Koike, Chino (JP)

(73) Assignee: Seiko Epson Corporation (JP)

( * ) Notice: Subject to any disclaimer, the term of this patent is extended or adjusted under 35 U.S.C. 154(b) by 437 days.

(21) Appl. No.: 11/083,101

(22) Filed: Mar. 17, 2005

(65) Prior Publication Data

US 2005/0219557 A1 Oct. 6, 2005

(30) Foreign Application Priority Data

Mar. 30, 2004 (JP) ..... 2004-099574
Mar. 30, 2004 (JP) ..... 2004-099575
Mar. 30, 2004 (JP) ..... 2004-099576

(51) Int. Cl.
*B41J 13/08* (2006.01)
*B65H 5/02* (2006.01)
*B65H 7/10* (2006.01)

(52) U.S. Cl. ..... 101/485; 347/104; 347/105

(58) Field of Classification Search ..... 101/484, 101/485; 347/116, 139, 104, 105; 271/226–255; *B41J 13/08; B65H 7/10, 5/02*

See application file for complete search history.

(56) References Cited

U.S. PATENT DOCUMENTS 5,587,771 A * 12/1996 Mori et al. ..... 399/72
6,155,669 A * 12/2000 Donahue et al. ..... 347/42
6,496,672 B2 12/2002 Asuwa et al. ..... 399/165
6,553,906 B1 * 4/2003 Bucks et al. ..... 101/211
6,672,705 B2 * 1/2004 Kitahara et al. ..... 347/42
6,964,468 B2 * 11/2005 Kitahara et al. ..... 347/42
2001/0043258 A1 * 11/2001 Ohki ..... 347/115

FOREIGN PATENT DOCUMENTS

JP 03177243 A * 8/1991
JP 06144631 A * 5/1994
JP 10-035021 2/1998
JP 10123794 A * 5/1998
JP 10139202 A * 5/1998
JP 10-207167 8/1998
JP 2000-071522 3/2000
JP 2000221860 A * 8/2000
JP 2002-099178 4/2002

OTHER PUBLICATIONS

Communication from Japanese Patent Office re: related application.

* cited by examiner

*Primary Examiner*—Jill E Culler
*Assistant Examiner*—'Wyn' Q Ha
(74) *Attorney, Agent, or Firm*—Harness, Dickey & Pierce, P.L.C.

(57) ABSTRACT

A printer ejects ink droplets continuously onto the left edge of an endless belt while the endless belt is rotating, stops the endless belt, detects the positions of the ink droplets on the endless belt, and thereby detects meandering of printing paper (Step S102). This makes it possible to prevent distortion of printed images caused by meandering of the printing paper based on the detected meandering, allowing information to be printed on an entire printing surface of the printing paper unlike, for example, a conventional method which prints register marks on printing paper, checks for meandering of the register marks, and thereby detects meandering of the printing paper.

2 Claims, 9 Drawing Sheets

PRINTER

BACKGROUND OF THE INVENTION

1. Field of the Invention

The present invention relates to a printer which prints in sequence on a print medium using a plurality of printer heads.

2. Description of the Related Art

Conventional printers of this type include, for example, a printer described in JP10-35021A. It comprises a plurality of printer heads each capable of printing a different color; and a transport portion which transports printing paper passing below the plurality of printer heads in sequence, wherein the plurality of printer heads print in sequence on the printing paper transported by the transport portion.

With such a printer, any meandering of printing paper during transport can distort a printed image. Thus, the printer described in JP10-35021A prints register marks on both edges of the printing paper during printing of a first color (during printing by the most upstream head), checks for meandering of the printed register marks during printing of second and subsequent colors (during printing by downstream heads), and thereby detects meandering of the printing paper. The printer moves the position of the printer heads as required based on the detected meandering so as to print each color in place, and thereby prevents distortion of the printed image.

However, with the conventional printer described above, since register marks are printed on the edges of the printing paper, it is not possible to print information on an entire surface of the printing paper. Consequently, to produce borderless prints, it is necessary to print the information on larger printing paper and then cut off the edges where the register marks are printed, involving great effort and expense.

To solve the outstanding problem with the conventional printer described above, the present invention has an object to provide a printer which can prevent distortion of printed images caused by meandering of printing paper and allows information to be printed on an entire surface of a print medium.

SUMMARY OF THE INVENTION

To achieve the above object, the present invention provides a printer which prints in sequence on a print medium transported by an endless belt looped over a plurality of rollers using a plurality of printer heads disposed at different locations along a transport direction of the print medium, comprising: a data generating section which generates print data for use to make the printer heads do printing; a meander detecting section which can detect meandering of the print medium by checking for meandering of the endless belt; and a head control section which moves the printer heads based on the meandering detected by meander detecting section and the print data generated by the data generating section.

The meander detecting section may comprise a marking section which can place marks in predetermined locations of the endless belt; and a mark meander detecting section which can detect meandering of the endless belt by checking for meandering of the placed marks.

Furthermore, the marking section may be able to continuously eject ink droplets to a width-direction end of the endless belt while the endless belt is rotating; and the mark meander detecting section may be able to detect meandering of the ink droplets while moving in the transport direction after the endless belt is stopped.

This configuration makes it possible, for example, to place marks on the width-direction end of the endless belt while the endless belt is rotating, stop the rollers, detect meandering of the placed marks, and thereby detect meandering of the print medium. This in turn makes it possible to move the printer heads so as to prevent distortion of printed images based on the detected meandering. Thus, it is possible to prevent distortion of printed images caused by meandering of the printing paper, allowing information to be printed on an entire printing surface of the printing paper unlike, for example a method which prints register marks on printing paper, checks for meandering of the register marks, and thereby detects meandering of the printing paper.

Also, the endless belt may be marked beforehand at predetermined locations; and the meander detecting section may comprise a mark meander detecting section which can detect meandering of the endless belt by checking for meandering of the marks while the endless belt is rotating.

Furthermore, the mark meander detecting section may be able to detect meandering of the marks passing near the printer heads while the endless belt is rotating.

Also, a plurality of mark meander detecting sections may be placed to accommodate respective printer heads.

Furthermore, the marks may be a line printed beforehand on the width-direction end of the endless belt and extending in the transport direction; and the mark meander detecting section may be able to detect meandering of the line after moving close to the printer heads along the transport direction while the endless belt is rotating.

Also, the endless belt may be marked at predetermined locations with a scale which extends in the transport direction; and the meander detecting section may comprise a scale meander detecting section which can detect meandering of the print medium by checking for meandering of the scale while the endless belt is rotating. The scale may be detectable optically, magnetically, or the like.

Furthermore, the scale meander detecting section may be able to detect meandering of the scale passing near the printer heads while the endless belt is rotating. Also, a plurality of scale meander detecting sections may be placed to accommodate respective printer heads.

Furthermore, the scale may comprise a light transmitting portion and a light shielding portion which are installed on the width-direction end of the endless belt and extend in the transport direction; and the scale meander detecting section may be able to detect meandering of the light shielding portion while the endless belt is rotating.

Also, the head control section may comprise a data correction section which corrects print data generated by the data generating section, based on the meandering of the print medium detected by the meander detecting section; and a printing section which makes the printer heads do printing, based on the corrected print data.

This configuration makes it possible to detect meandering of marks or a scale placed in advance, and thereby detect meandering of the print medium while the endless belt is rotating.

To achieve the above object, the present invention provides a printer which prints in sequence on a print medium transported by an endless belt looped over a plurality of rollers using a plurality of printer heads disposed at different locations along a transport direction of the print medium, comprising: a data generating section which generates print data for use to make the printer heads do printing; a meander detecting section which can detect meandering of the print medium; a correction data generating section which generates correction data based on the detected meandering to prevent distortion of printed images caused by meandering of the print medium; and a head control section which moves the printer heads based on the generated correction data as well as on the print data generated by the print data generating section, wherein the head control section uses common correction data generated by the correction data generating section for a plurality of print media.

The head control section may comprise a data correction section which corrects print data generated by the print data generating section, based on the correction data generated by the correction data generating section, and a printing section which makes the printer heads do printing, based on the corrected print data; the data correction section may correct common print data generated by the print data generating section, based on the common correction data generated by the correction data generating section; and the printing section may print on a plurality of print media, based on the corrected print data.

Furthermore, the head control section may comprise a data correction section which corrects print data generated by the print data generating section, based on the correction data generated by the correction data generating section, and a printing section which makes the printer heads do printing, based on the corrected print data; the data correction section may correct a plurality of mutually different print data generated by the print data generating section, based on the common correction data generated by the correction data generating section; and the printing section may print on a plurality of print media, based on the corrected print data.

When printing on a plurality of print media, this configuration makes it possible to reduce the effort required to generate correction data (time required to generate correction data) compared to a method which generates correction data for each sheet, and thereby increase printing speed.

Furthermore, circumference of the endless belt may be an integral multiple of circumference of the rollers over which the endless belt is looped.

This configuration causes any given part of the endless belt to always contact the same parts of the rollers. Consequently, meandering of the endless belt resulting from contact with the rollers occurs periodically, causing periodicity in the meandering of the print media to appear more clearly. This makes it possible to properly prevent distortion of printed images caused by the meandering of the print media even when common correction data is used for the plurality of print media.

Also, the print media may be attached to particular locations of the endless belt by suction during transport of the print media.

This configuration causes periodicity in the meandering of the print media resulting from periodic meandering of the endless belt to appear more clearly. This makes it possible to more properly prevent distortion of printed images caused by the meandering of the print media even when common correction data is used for the plurality of print media.

DESCRIPTION OF THE PREFERRED EMBODIMENTS

A line printer, an embodiment of the printer according to the present invention will be described below with reference to the drawings.

First Embodiment

<Configuration of Line Printer>

Figure 1A:
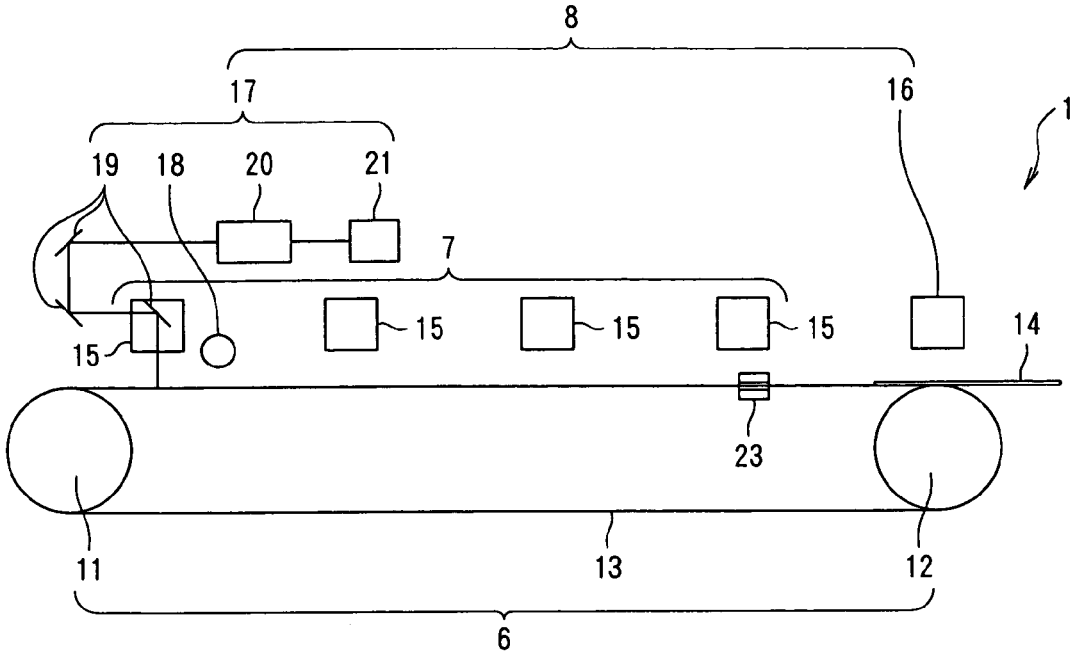
FIGS. 1A and 1B are a side view and plan view showing external appearance of a first embodiment.
Figure 1B:
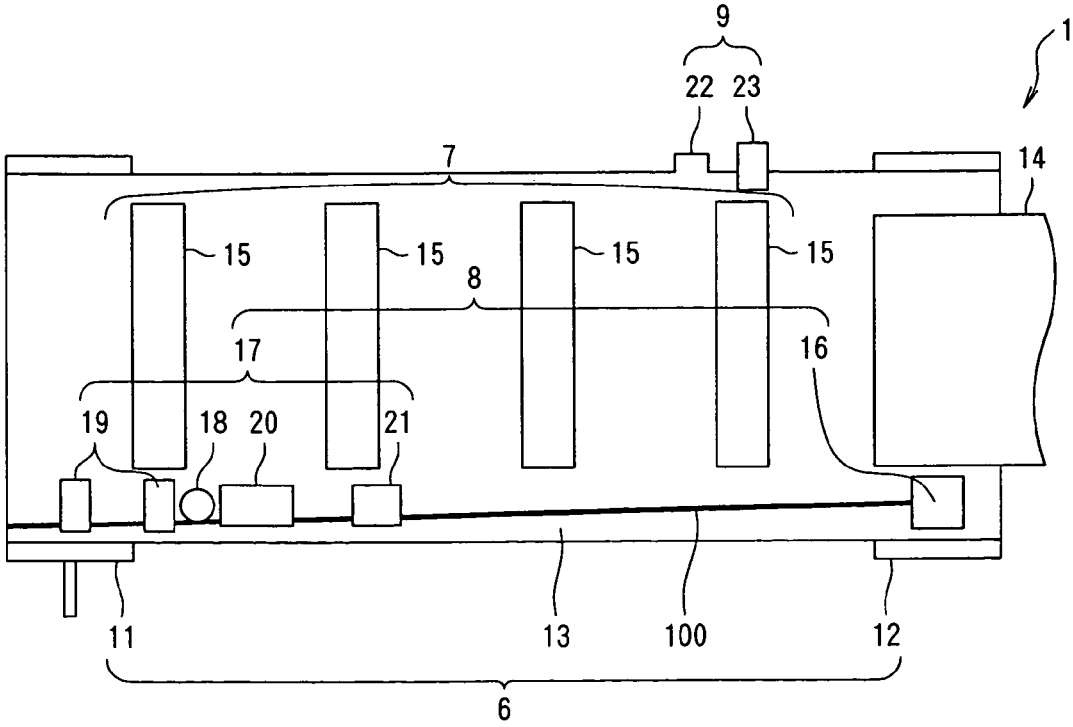
Figure 2:
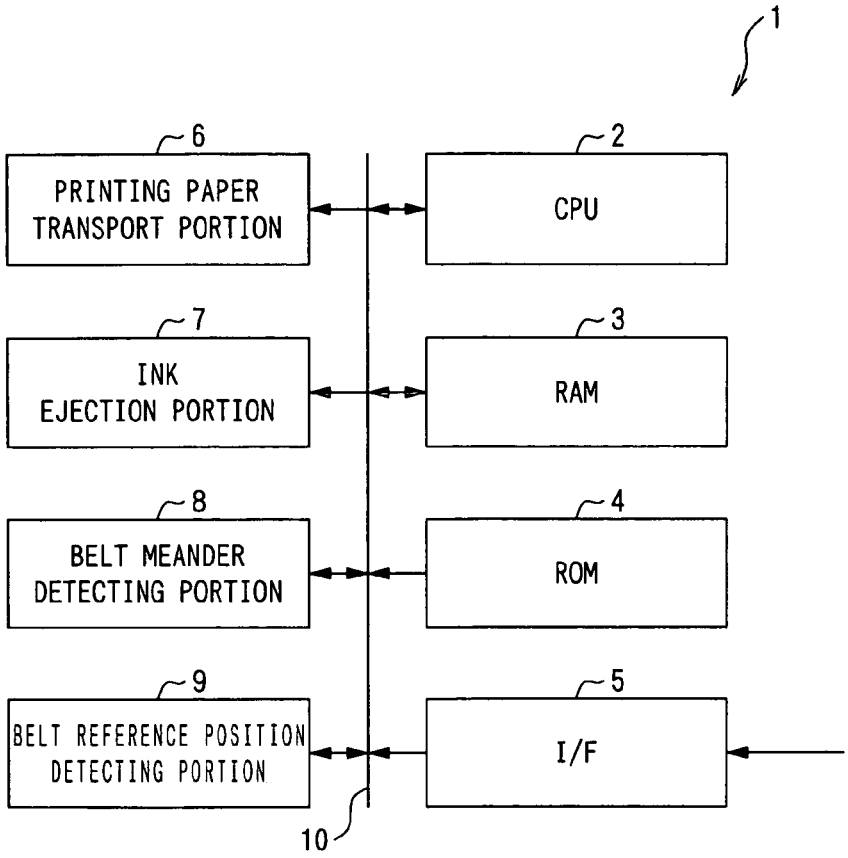
FIG. 2 is a block diagram showing internal configuration of the line printer 1 shown in FIGS. 1A and 1B.

FIGS. 1A and 1B are a side view and plan view showing external appearance of a line printer according to a first embodiment while FIG. 2 is a block diagram showing internal configuration of the line printer according to the first embodiment. As shown in FIG. 2, the line printer 1 comprises a CPU (Central Processing Unit) 2, RAM (Random Access Memory) 3, ROM (Read Only memory) 4, I/F (InterFace) 5, printing paper transport portion 6, ink ejection portion 7, and belt meander detecting portion 8, belt reference position detecting portion 9, where the components 2 to 9 are interconnected via a bus 10 so as to be ready for data exchange.

When a print command (described later) is outputted from the I/F 5, the CPU 2 reads various programs and data from the ROM 4 and loads them into a work area in the RAM 3, and thereby executes a printing process described later. During execution of the printing process, the CPU 2 controls the components 3 to 9 so that information such as images and characters will be printed on printing paper 14 (described later) according to the print command (described later).

The RAM 3 provides a work area to load various programs executed by the CPU 2 as well as a memory area to store data for use during execution of the loaded programs. Also, the RAM 3 outputs stored data to the CPU 2 in response to a read request outputted by the CPU 2.

The ROM 4 prestores various programs and data in forms executable by the CPU 2. The ROM 4 outputs prestored programs and data to the CPU 2 in response to a read request outputted by the CPU 2.

The I/F 5 is interconnected with a personal computer (not shown) so as to be ready for data exchange, where the personal computer outputs data corresponding to information to be printed on the line printer 1. When the data is outputted from the personal computer, the I/F 5 outputs a command instructing the CPU 2 to print the information corresponding to the data on the line printer 1 (hereinafter also referred to as a "print command").

As shown in FIGS. 1A and 1B, the printing paper transport portion 6 comprises a driving roller 11 which can be rotated by a servomotor (not shown), a rotatable driven roller 12 equal in diameter to the driving roller 11, an endless belt 13 looped between the rollers 11 and 12, and a sucking section (not shown) which attaches the printing paper 14 to a surface of the endless belt 13 by suction. The circumference of the endless belt 13 is set to be an integral multiple of the circumference of the driving roller 11.

When a print control command (described later) is outputted by the CPU 2, the printing paper transport portion 6 rotates the driving roller 11 at a fixed speed, causing the endless belt 13 looped over the driving roller 11 to start rotating. Then, the printing paper transport portion 6 feeds the printing paper 14 to a particular location at the width-direction center of the endless belt 13 in such a way that the front end of the printing paper 14 will align with a straight line extending in the direction orthogonal to the direction in which the printing paper 14 is transported by the rotation of the endless belt 13 (hereinafter also referred to as the "paper feed direction") and transports the printing paper 14 attached to the particular location by suction.

The ink ejection portion 7 comprises four printer heads 15 placed at different locations along the paper feed direction above the endless belt 13. The four printer heads 15 are larger than the printing paper 14 in the dimension orthogonal to the paper feed direction. Each printer head 15 has a plurality of nozzles formed in its bottom face and the nozzles are capable of ejecting one ink out of black, cyan, magenta, and yellow inks vertically downward. The nozzles in the same printer head 15 are aligned in the direction orthogonal to the paper feed direction while corresponding nozzles in different printer heads 15 are aligned in the paper feed direction.

When a print control command is outputted by the CPU 2, the ink ejection portion 7 makes the nozzles eject ink droplets using the ink ejection timing, number of ink ejections, and dot size (e.g., three sizes of L, M, and S) specified by the print control command, and thereby prints information on the printing paper 14 transported by the endless belt 13 according to the print control command.

The belt meander detecting portion 8 comprises a meander detecting printer head 16 placed above the left edge of the endless belt 13 as viewed in the paper feed direction, i.e., above that part of the endless belt 13 to which no printing paper 14 is attached and which is located on the most upstream side in the paper feed direction; and an imaging device 17 placed downstream of the meander detecting printer head 16 in the paper feed direction. The meander detecting printer head 16 has in its bottom face a nozzle capable of ejecting black ink. Besides, the imaging device 17 is equipped with a CCD camera 21 capable of picking up images of the left edge of the endless belt 13 where the black ink is ejected by the meander detecting printer head 16, by moving in the paper feed direction and using a lamp 18, a plurality of reflectors 19, and a lens 20.

When a meander detection command (described later) is outputted by the CPU 2, the belt meander detecting portion 8 rotates the driving roller 11 at a fixed speed, causing the endless belt 13 looped over the driving roller 11 to start rotating, ejects ink droplets continuously from the meander detecting printer head 16, and thereby prints a straight line 100 on the left edge of the endless belt 13. Then, the belt meander detecting portion 8 stops the rotation of the driving roller 11, picks up images of the left edge of the endless belt 13 with the CCD camera 21 by moving the imaging device 17 in the paper feed direction, detects the positions of the ink droplets on the endless belt 13, and thereby detects meandering of the endless belt 13 as shown in a graph in FIG. 3. The graph in FIG. 3 has its origin located at the point of intersection between a straight line extending from an index 22 (described later) in the direction orthogonal to the paper feed direction and the start point of the straight line 100 printed by the meander detecting printer head 16. The distance in the direction opposite to the paper feed direction (hereinafter also referred to as the "reference point travel distance") is represented by a positive value of the horizontal axis and the amount of meandering (hereinafter also referred to as the "amount of the belt's meandering) in the right hand direction as viewed in the paper feed direction is represented by a positive value of the vertical axis.

The belt reference position detecting portion 9 comprises the index 22 formed on the right edge of the endless belt 13 as viewed in the paper feed direction, and an index detection sensor 23 which detects that the index 22 passes near the most upstream printer head 15 as viewed in the paper feed direction. When the index detection sensor 23 detects passage of the index 22, the belt reference position detecting portion 9 outputs a command instructing the CPU 2 to start transporting the printing paper 14 (hereinafter also referred to as a "print paper transport start command").

<Details of Printing Process>

Now, the printing process executed by the CPU 2 will be described with reference to a flowchart in FIG. 4. The printing process is executed after a print command is outputted from the I/F 5. In Step S101, to print information according to the print command outputted from the I/F 5, the CPU 2 generates print data which indicates ink ejection timing, the number of ink ejections, and dot size for each nozzle and stores the generated print data in the RAM 3.

Then, the CPU 2 goes to Step S102, where it outputs a command instructing the belt meander detecting portion 8 to detect meandering of the endless belt 13 (hereinafter also referred to as a "meander detection command").

Figure 5:
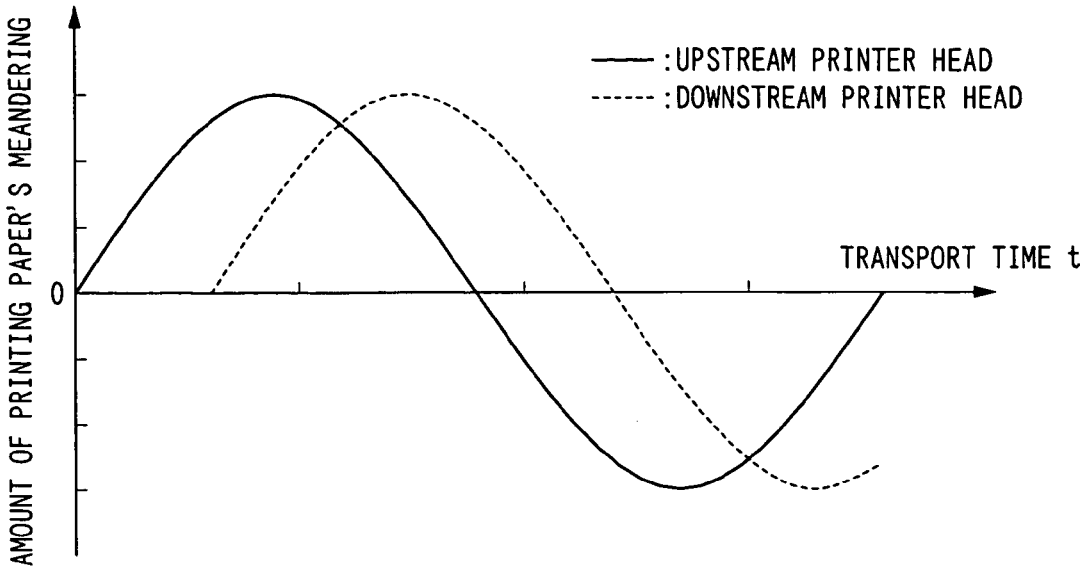
FIG. 5 is a graph illustrating meandering of an endless belt.

Then, the CPU 2 goes to Step S103, where it calculates meandering of the printing paper 14 right under each printer head 15, i.e., the amount of the belt's meandering with respect to elapsed time t after the printing paper 14 starts to be transported (hereinafter also referred to as "transport time")), based on the meandering of the endless belt 13 detected by the belt meander detecting portion 8 as shown in FIG. 5, and designates the results of calculation as the amount of meandering of the printing paper 14 (hereinafter also referred to as the "amount of the printing paper's meandering). Specifically, the meandering of the printing paper 14 right under the most upstream printer head 15 as viewed in the paper feed direction is calculated by dividing the horizontal axis of the graph in FIG. 3, i.e., the reference point travel distance, by the rotational speed of the endless belt 13 as indicated by the solid line in FIG. 5. On the other hand, the meandering of the printing paper 14 right under the most downstream printer head 15 is calculated by lagging the meandering of the printing paper 14 right under the most upstream printer head 15 by the time calculated by dividing the distance from the most upstream printer head 15 to the most downstream printer head 15 by the rotational speed of the endless belt 13 as indicated by the broken line in FIG. 5.

Then, the CPU 2 goes to Step S104, where it generates correction data used to shift and thereby correct the print data generated in Step S101, based on the amount of the printing paper's meandering calculated in Step S103, in order to prevent distortion of printed images caused by meandering of the printing paper 14 and thereby print information properly on the printing paper according to the print command outputted from the I/F 5.

Specifically, the amount of the printing paper's meandering right under each printer head 15 calculated in Step S103 is divided by the nozzle pitch of the printer head 15. Then, it is determined whether the quotient obtained for the meandering right under the i-th (i=1 to 4) printer head from the upstream end as viewed in the paper feed direction at the transport time t is a positive value. If the quotient is a positive value, the CPU 2 generates correction data used to shift and thereby correct the print data stored in the RAM 3 such that n items of print data for each nozzle at the transport time t of the i-th printer head 15 will become print data for the nozzle on the immediate right as viewed in the paper feed direction, where n is the integer nearest to the quotient. If the quotient is a negative value, the CPU 2 generates correction data used to shift and thereby correct the print data stored in the RAM 3 such that n items of print data for each nozzle at the transport time t of the i-th printer head 15 will become print data for the nozzle on the immediate left as viewed in the paper feed direction, where n is the integer nearest to the quotient.

Then, the CPU 2 goes to Step S105, where it shifts and thereby corrects the print data stored in the RAM 3 based on the correction data generated in Step S104.

Then, the CPU 2 goes to Step S106, where it judges whether a print paper transport start command has been outputted by the belt reference position detecting portion 9. If such a command has been outputted (Yes), the CPU 2 goes to Step S107. If no such command has been outputted (No), the CPU 2 repeats the judgment.

In Step S107, the CPU 2 outputs a command instructing the printing paper transport portion 6 and ink ejection portion 7 to eject ink droplets from each nozzle using the ink ejection timing, number of ink ejections, and dot size specified in the print data stored in the RAM 3 (hereinafter also referred to as a "print control command").

Then, the CPU 2 goes to Step S108, where it judges whether printing on a predetermined number of sheets (e.g., ten sheets) has been completed. If the printing has been completed (Yes), the CPU 2 finishes the computational process. Otherwise (No), the CPU 2 returns to Step S106.

<Operation of Line Printer>

Next, operation of the line printer 1 according to this embodiment will be described in relation to concrete situations.

Figure 6B:
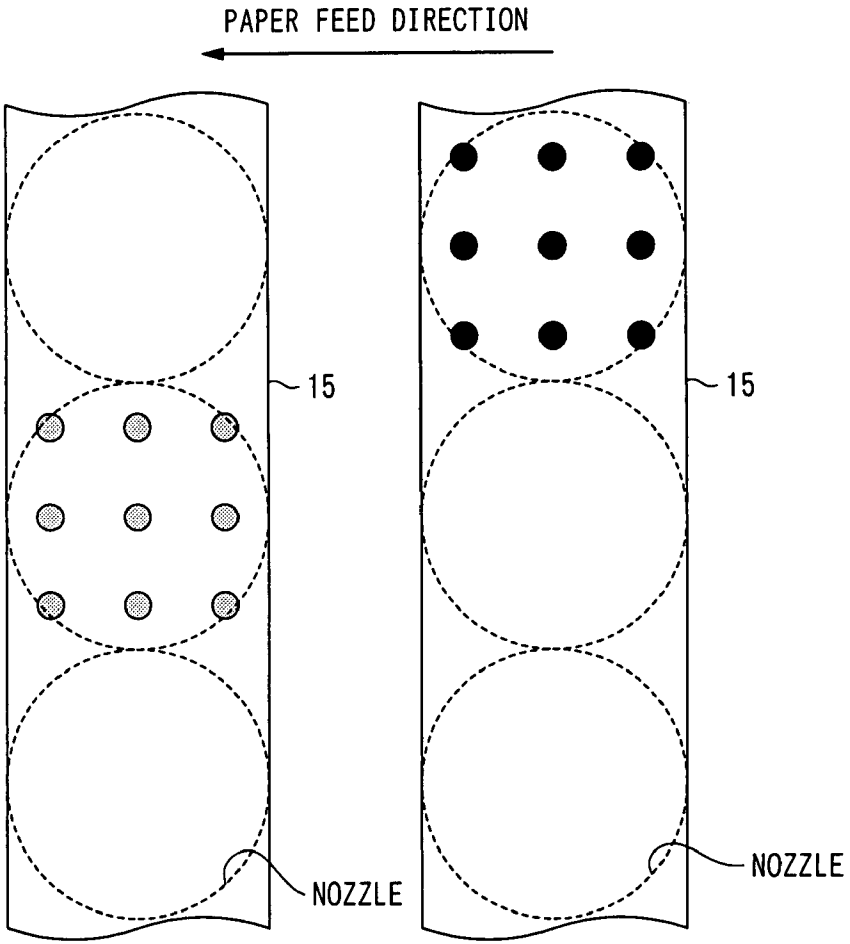
FIGS. 6A to 6B are explanatory diagrams illustrating operation of the first embodiment.
Figure 6A:
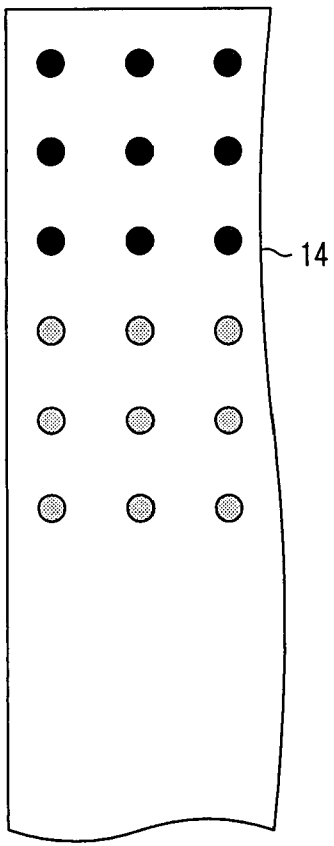

Assume that data corresponding to information to be printed is outputted from a personal computer (not shown) and that a print command is outputted from the I/F 5 according to the data. Then, the CPU 2 executes a printing process as follows. First, in Step S101 in FIG. 4, a set of print data specifying the ink ejection timing, number of ink ejections, and dot size for each nozzle to eject ink droplets is generated and stored in the RAM 3 as shown in FIG. 6A. FIG. 6A shows print data for an upstream nozzle and downstream nozzle generated so that the ink droplets ejected from the upstream nozzle and the ink droplets ejected from the downstream nozzle will fall in adjacent locations on the front end of the printing paper 14 as shown in FIG. 6B assuming that the printing paper 14 is transported without meandering, where the upstream nozzle is a nozzle of a printer head 15 located upstream as viewed in the paper feed direction while the downstream nozzle is a nozzle of a printer head 15 located downstream.

Figure 3:
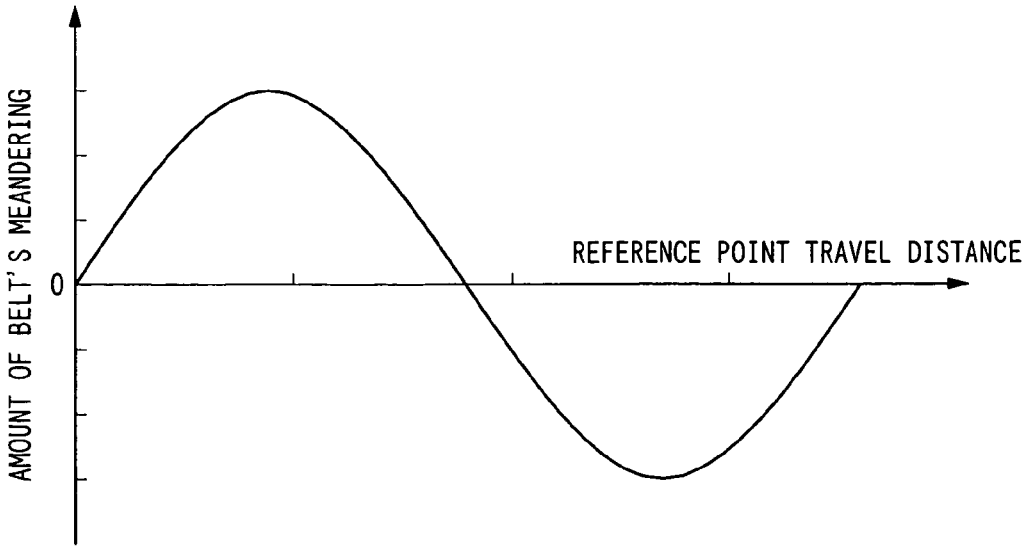
FIG. 3 is a graph illustrating meandering of an endless belt.
Figure 7B:
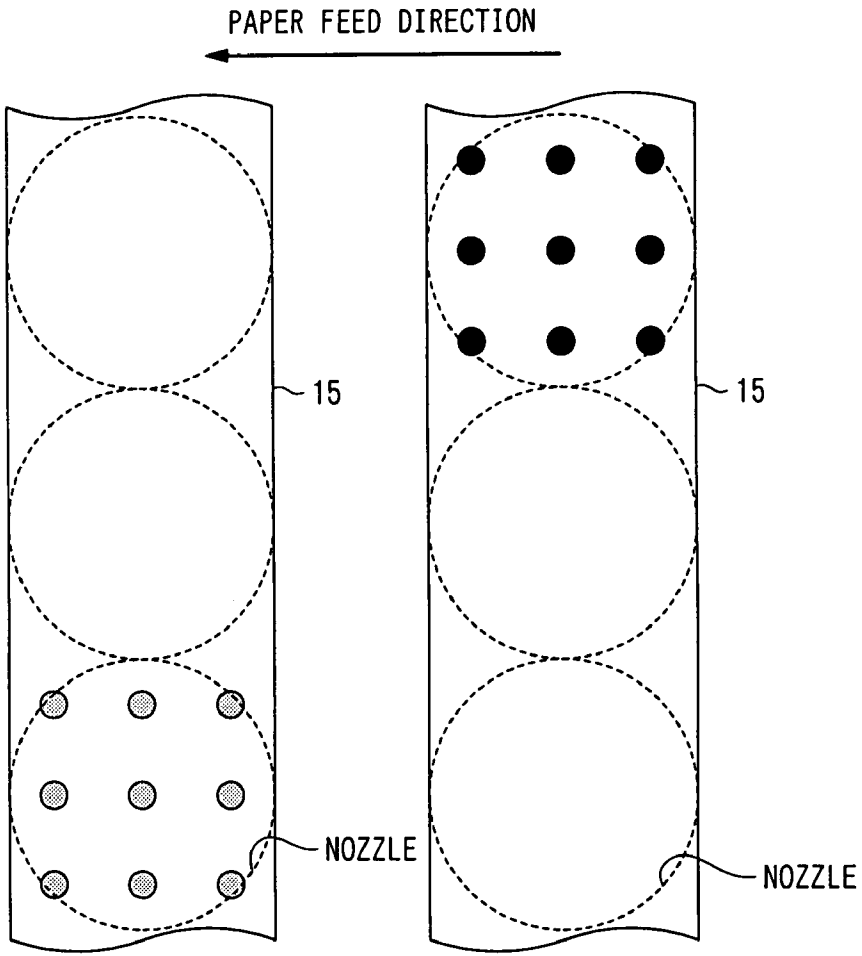
FIGS. 7A and 7B are explanatory diagrams illustrating operation of the first embodiment.
Figure 7A:
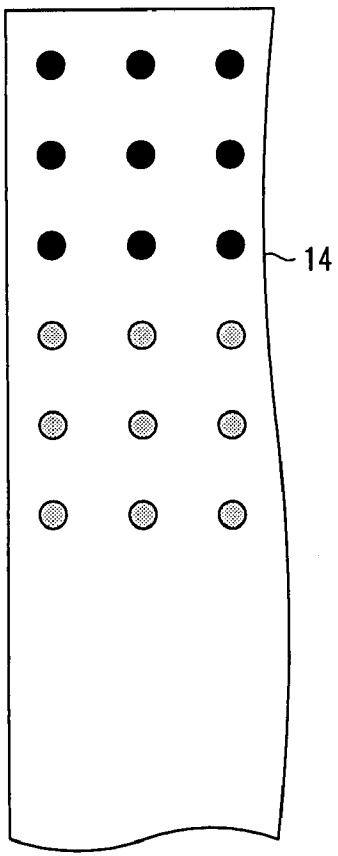

In Step S102, a meander detection command is outputted. Then, the belt meander detecting portion 8 makes the endless belt 13 start rotating, ink droplets are ejected continuously onto the left edge of the endless belt 13, the driving roller 11 is stopped, meandering of the ink droplets is detected, and then meandering of the endless belt 13 is detected as shown in FIG. 3. Then, in Step S103, the meandering of the printing paper 14 right under each printer head 15 is calculated based on the meandering detected by the belt meander detecting portion 8 as shown in FIG. 5. In Step S104, a set of (common) correction data is generated based on the calculated meandering. In Step S105, the set of print data stored in the RAM 3 is corrected based on the generated set of correction data as shown in FIG. 7A. FIG. 7B shows print data for an upstream nozzle and downstream nozzle with the position of the downstream nozzle corrected so that the ink droplets ejected from the upstream nozzle and the ink droplets ejected from downstream nozzle will fall in adjacent locations on the front end of the printing paper 14 assuming that the printing paper 14 is transported by the printing paper transport portion 6 with meandering.

Assume that the index 22 has passed near the index detection sensor 23. Then, a print paper transport start command is outputted by the belt reference position detecting portion 9, the judgment in Step S106 gives a "Yes," and a print control command is outputted according to the set of print data stored in the RAM 3 in Step S107. Then, the printing paper transport portion 6 starts the endless belt 13 to rotate, printing paper 14 is attached to a particular location of the endless belt 13 by suction, and the attached printing paper 14 is transported to below the printer heads 15. At the same time, the ink ejection portion 7 ejects ink droplets from each nozzle with the timing and the like specified in the print control command as shown in FIG. 7A and information specified in the print control command, i.e., information corresponding to the data outputted from the personal computer, is printed properly on the printing paper 14 transported by the endless belt 13 as shown in FIG. 7B. Then, the judgment in Step S108 gives a "No" and Steps S106 to S108 are repeated 10 times reusing the set of print data stored in the RAM 3 to print on ten sheets of printing paper.

In this way, the line printer 1 according to this embodiment ejects ink droplets continuously onto the left edge of the endless belt 13 while the endless belt 13 is rotating, stops the endless belt 13, detects the positions of the ink droplets on the endless belt 13, and thereby detects meandering of the printing paper 14. This makes it possible to prevent distortion of printed images caused by meandering of the printing paper 14 based on the detected meandering, allowing information to be printed on an entire printing surface of the printing paper 14 unlike, for example, a conventional method which prints register marks on printing paper 14, checks for meandering of the register marks, and thereby detects meandering of the printing paper 14.

Also, a set of print data is corrected based on a set of correction data and printing is done on multiple sheets of printing paper 14 based on the corrected set of print data. When printing on a plurality of print media, this method makes it possible to reduce the effort required to generate correction data (time required to generate correction data) compared to a method which generates correction data for each sheet, and thereby increase printing speed.

Although in this embodiment, a set of print data is generated according to a print command and the same information is printed on ten sheets of printing paper 14, based on the corrected set of print data, this is not restrictive. For example, it is alternatively possible to generate multiple sets of print data different from each other, correct the generated sets of print data using a set of (common) correction data, and print mutually different information on ten sheets of printing paper 14 based on the corrected sets of print data.

Also, this embodiment causes any given part of the endless belt to always contact the same parts of the driving roller 11 or driven roller 12 by setting the circumference of the endless belt 13 to an integral multiple of the circumference of the driving roller 11 or driven roller 12. Consequently, meandering of the endless belt 13 resulting from contact with the driving roller 11 or driven roller 12 occurs periodically, causing periodicity in the meandering of the printing paper 14 to appear more clearly. This makes it possible to properly prevent distortion of printed images caused by the meandering of the printing paper 14 even when a set of correction data is used for multiple sheets of printing paper 14.

Also, since the printing paper is attached to the endless belt 13 by suction during transport of the printing paper 14, periodicity in the meandering of the printing paper 14 resulting from periodic meandering of the endless belt 13 appears more clearly. This makes it possible to more properly prevent distortion of printed images caused by the meandering of the printing paper 14 even when a set of correction data is used for multiple sheets of printing paper 14.

Second Embodiment

Next, a line printer 1 according to a second embodiment will be described.

This embodiment differs from the first embodiment in that a straight line 200 extending in the paper feed direction has been printed in advance on the left edge of the endless belt 13 as viewed in the paper feed direction and that meandering of the printing paper 14 is detected by checking for meandering of the straight line 200 passing near each printer head 15 while the endless belt 13 is rotating. Specifically, according to the first embodiment, ink droplets are ejected continuously onto the endless belt 13 while the endless belt 13 is rotating. Consequently, any meandering of the endless belt 13 is reflected in the printed straight line 100, making it possible to detect the amount of meandering of the endless belt 13 by detecting the printed straight line 100 when the endless belt 13 is at rest. On the other hand, according to the second embodiment, the amount of meandering of the endless belt 13 is detected by checking for meandering of the straight line 200 printed in advance on the endless belt 13 while the endless belt 13 is rotating.

Figure 8A:
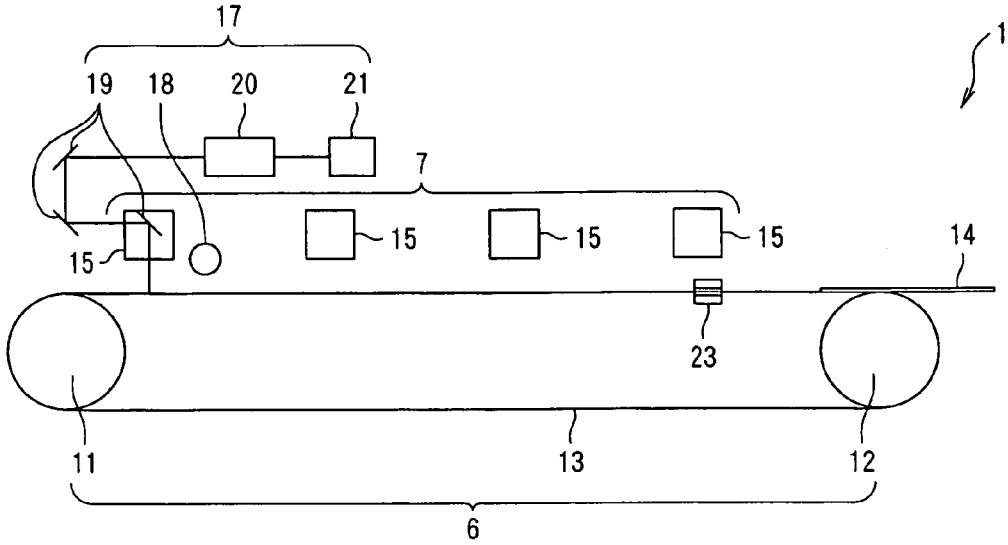
FIGS. 8A and 8B are a side view and plan view showing external appearance of a second embodiment.
Figure 8B:
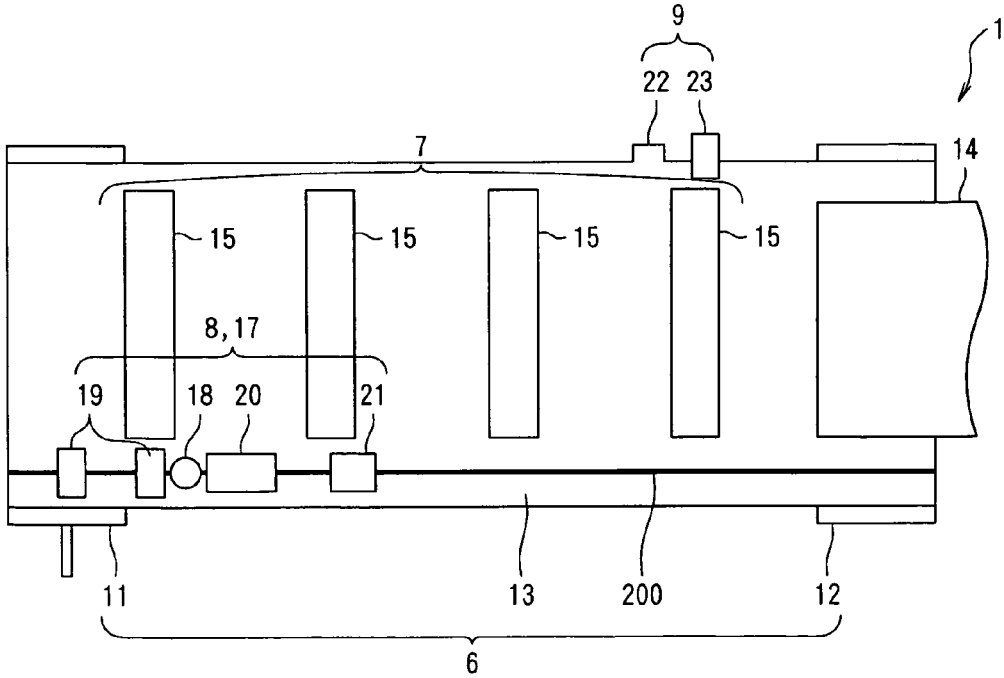

Specifically, in the second embodiment, the belt meander detecting portion 8 comprises only the imaging device 17 with the meander detecting printer head 16 omitted as shown in FIGS. 8A and 8B. Besides, the imaging device 17 is equipped with the CCD camera 21 capable of moving close to each printer head 15 along the transport direction and picking up images of the left edge of the endless belt 13 where the straight line 200 has been printed in advance, by moving in the paper feed direction and using the lamp 18, reflectors 19, and lens 20.

When a meander detection command is outputted by the CPU 2, the belt meander detecting portion 8 rotates the driving roller 11 at a fixed speed, causing the endless belt 13 looped over the driving roller 11 to start rotating. Then, the belt meander detecting portion 8 moves the imaging device 17 close to each printer head 15 along the transport direction, picks up images of the left edge of the endless belt 13 in sequence with the CCD camera 21, detects the straight line 200 printed in advance, and thereby detects the meandering of the endless belt right under each printer head 15 as shown in the graph in FIG. 5.

Incidentally, the second embodiment has a lot of the same components as the first embodiment. Thus, the same components as those in the first embodiment are denoted by the same reference numerals and detailed description thereof is omitted.

In this way, the line printer 1 according to this embodiment can detect meandering of the printing paper 14 by checking for meandering of the straight line 200 printed in advance on the endless belt 13 and thereby detecting meandering of the endless belt 13 while the endless belt 13 is rotating. This makes it possible to print information on the entire printing surface of the printing paper 14 without the need to print marks for detecting meandering of the printing paper 14 on the printing surface of the printing paper 14.

Although this embodiment involves moving the imaging device 17 close to each printer head 15 and picking up images of the left edge of the endless belt 13 (the straight line 200 printed in advance on the endless belt 13) in sequence with the CCD camera 21, this is not restrictive. For example, it is alternatively possible to install an imaging device 17 near each printer head 15 and pick up images of the left edge of the endless belt with CCD cameras 21 of the imaging devices 17 simultaneously. This will make it possible to detect the meandering of the printing paper 14 right under each printer head 15 in a short period of time.

Third Embodiment

Next, a line printer 1 according to a third embodiment will be described.

This embodiment differs from the first embodiment in that a linear scale 25 extending in the paper feed direction is placed on the left edge of the endless belt 13 as viewed in the paper feed direction and that meandering of the printing paper 14 is detected by checking for meandering of the linear scale 25 passing near each printer head 15 while the endless belt 13 is rotating.

Figure 9A:
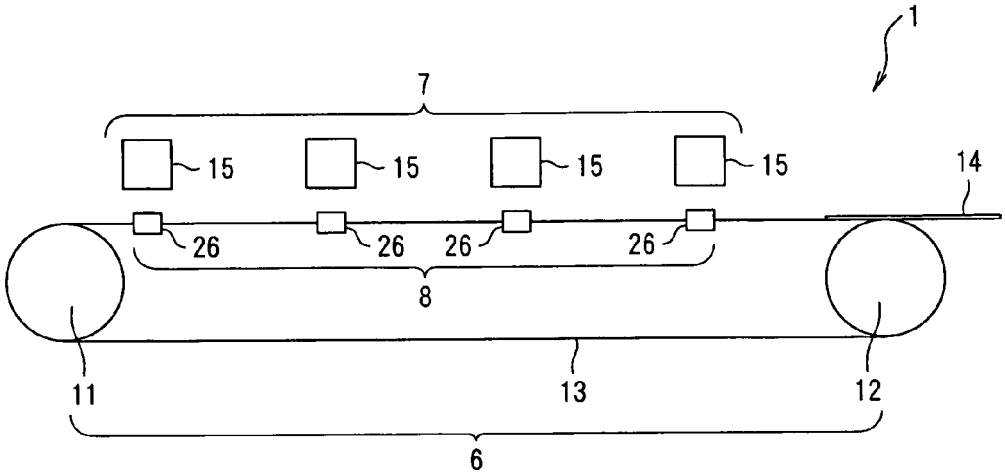
FIGS. 9A and 9B are a side view and plan view showing external appearance of a third embodiment.
Figure 9B:
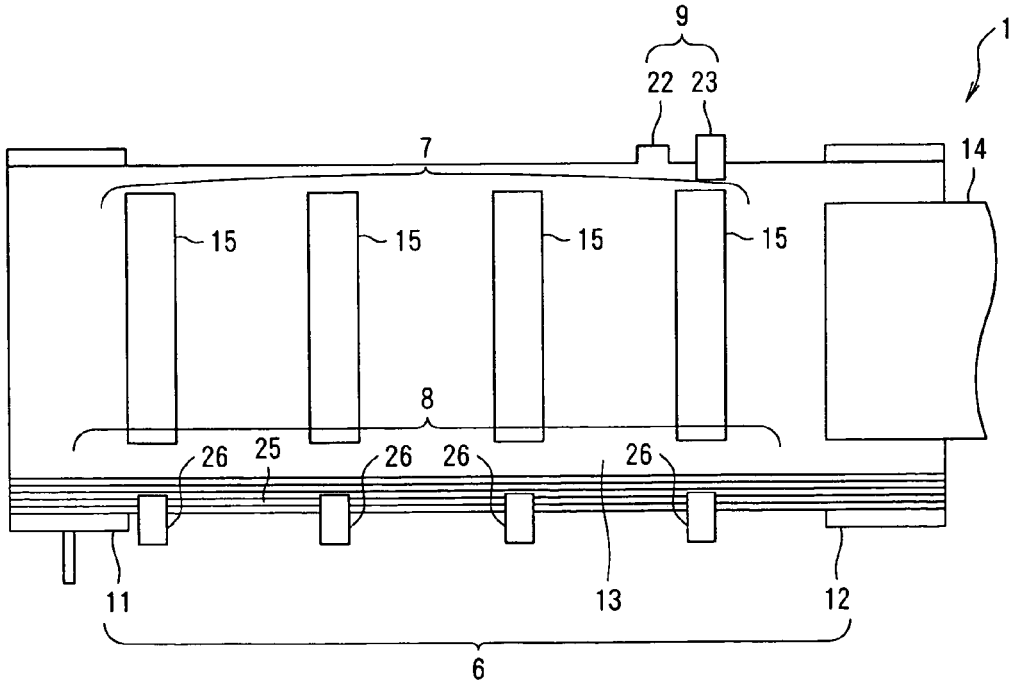

Specifically, in the third embodiment, the belt meander detecting portion 8 comprises the linear scale 25 placed on the left edge of the endless belt 13 in the paper feed direction, i.e., along that part of the endless belt 13 to which no printing paper 14 is attached; and four linear encoders 26 placed near respective printer heads 15 as shown in FIGS. 9A and 9B. The linear scale 25 has a plurality of slits extending in the paper feed direction at equal intervals. Each linear encoder 26 has a light-emitting diode (not shown) which is placed on the top side of the linear scale 25 and photoreceptor (not shown) which is placed on the underside. Each linear encoder 26 makes the photoreceptor detect light emitted from the light-emitting diode, thereby counts the number of times the slits pass between the light-emitting diode and photoreceptor, and thereby detects meandering of the slits passing near the printer head 15.

When a meander detection command is outputted by the CPU 2, the belt meander detecting portion 8 rotates the driving roller 11 at a fixed speed, causing the endless belt 13 looped over the driving roller 11 to start rotating. Then, the belt meander detecting portion 8 detects meandering of the slits with the linear encoders 26, thereby checks for meandering of the linear scale 25, and thereby detects meandering of the endless belt 13 right under each printer head 15 as shown in the graph in FIG. 3. In Step S103 of the printing process, the meandering of the endless belt 13 detected by the belt meander detecting portion 8 is set as the amount of the printing paper's meandering at the transport time t. Incidentally, the third embodiment has a lot of the same components as the first embodiment. Thus, the same components as those in the first embodiment are denoted by the same reference numerals and detailed description thereof is omitted.

In this way, the line printer 1 according to this embodiment can detect meandering of the printing paper 14 by checking for meandering of the linear scale 25 on the left edge of the endless belt 13 and thereby detecting meandering of the endless belt 13 while the endless belt 13 is rotating. This makes it possible to print information on the entire printing surface of the printing paper 14 without the need to print marks for detecting meandering of the printing paper 14 on the printing surface of the printing paper 14.

Although this embodiment uses the linear scale 25 with slits extending in the paper feed direction and the linear encoders 26 to detect meandering of the linear scale 25 optically, this is not restrictive. For example, a scale with a grid pattern may be used together with magnetic sensor heads to detect meandering of the linear scale magnetically.

Figure 4:
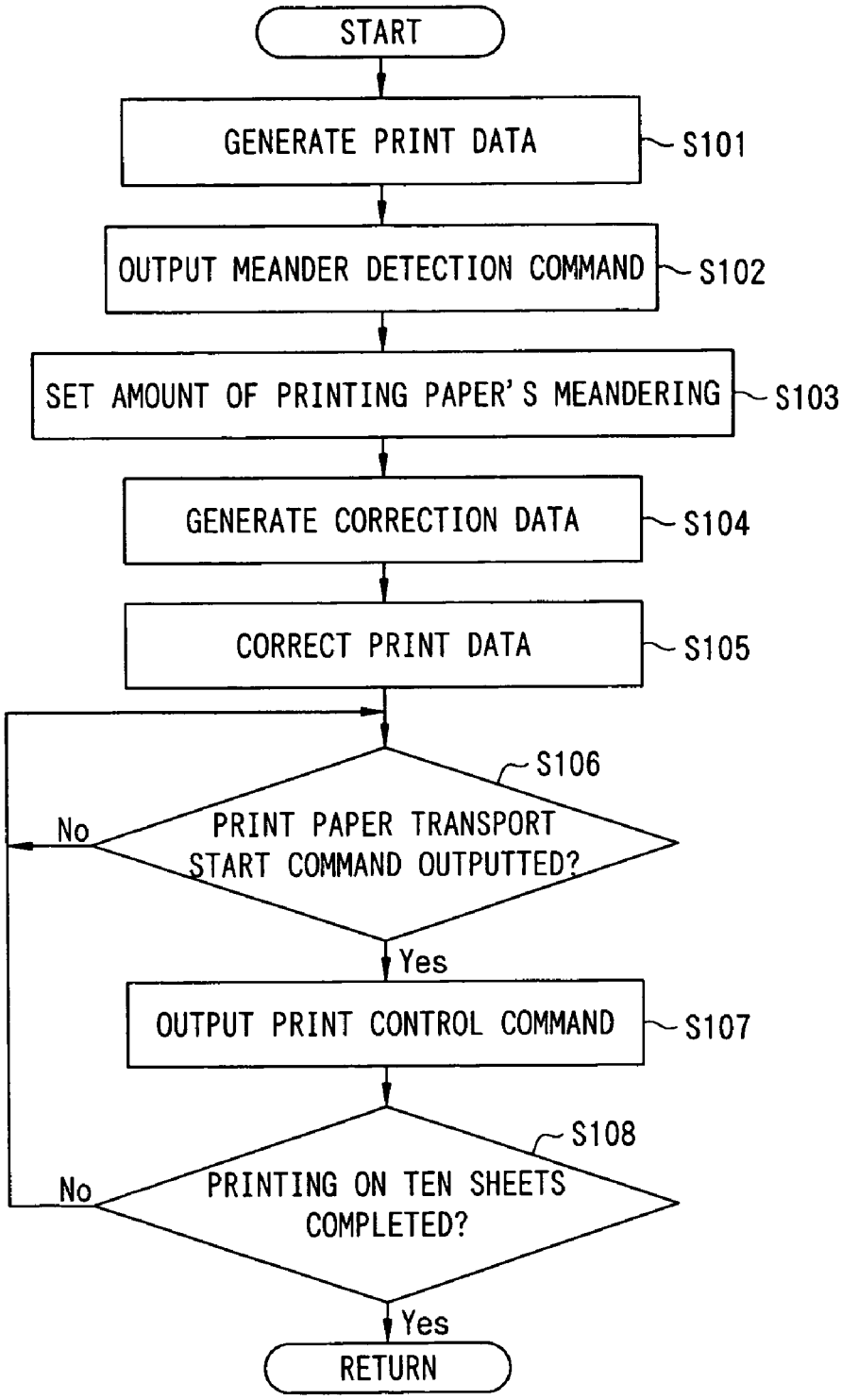
FIG. 4 is a flowchart of a printing process.

The CPU 2 in FIG. 2 and Step S101 in FIG. 4 constitute the data generating section described in claims. Similarly, the belt meander detecting portion 8, meander detecting printer head 16, lamp 18, reflectors 19, lens 20, and CCD camera 21 in FIGS. 1A and 1B, the CPU 2 and the belt meander detecting portion 8 in FIG. 2, Steps S102 and S103 in FIG. 4, and the linear scale 25, linear encoders 26, light-emitting diodes, and photoreceptors in FIGS. 9A and 9B constitute the meander detecting section. The CPU 2, printing paper transport portion 6, and ink ejection portion 7 in FIG. 2 and Steps S104 to S108 in FIG. 4 constitute the head control section. The meander detecting printer head 16 in FIGS. 1A and 1B, the CPU 2 and belt meander detecting portion 8 in FIGS. 2, 8A and 8B, and Step S102 in FIG. 4 constitute the marking section. The lamp 18, reflectors 19, lens 20, and COD camera 21 in FIGS. 1A and 1B, the CPU 2 and belt meander detecting portion 8 in FIG. 2, and Steps S102 and S103 in FIG. 4 constitute the mark meander detecting section. The linear scale 25, linear encoders 26, light-emitting diodes, and photoreceptors in FIGS. 9A and 9B and Steps S102 and S103 in FIG. 4 constitute the scale meander detecting section. The CPU 2 in FIG. 2 and Steps S104 and S105 in FIG. 4 constitute the data correction section. The CPU 2, printing paper transport portion 6, and ink ejection portion 7 in FIG. 2 and Steps S106 to S108 in FIG. 4 constitute the printing section. The CPU 2 in FIG. 2 and Step S104 in FIG. 4 constitute the correction data generating section.

Incidentally, the printer according to the present invention is not limited to the above embodiments and may be modified as required without departing from the spirit of the present invention.

Although in the above embodiments, the ink ejection portion 7 has a plurality of large line heads, this is not restrictive. For example, the ink ejection portion 7 may have a single small serial head which can move in the direction orthogonal to the paper feed direction.

Figure 10A:
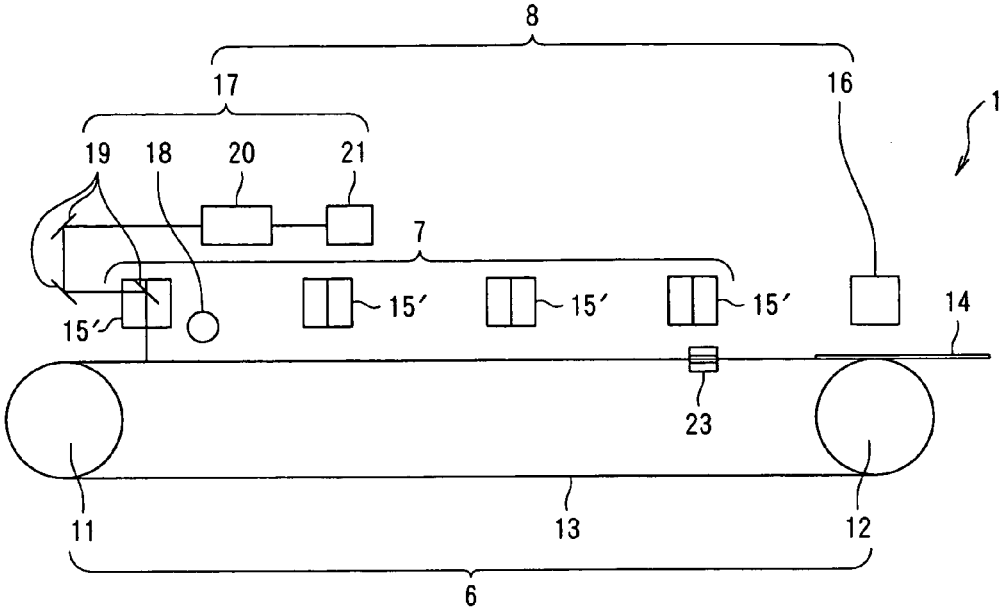
FIGS. 10A and 10B are explanatory diagrams illustrating a variation of the present invention.
Figure 10B:
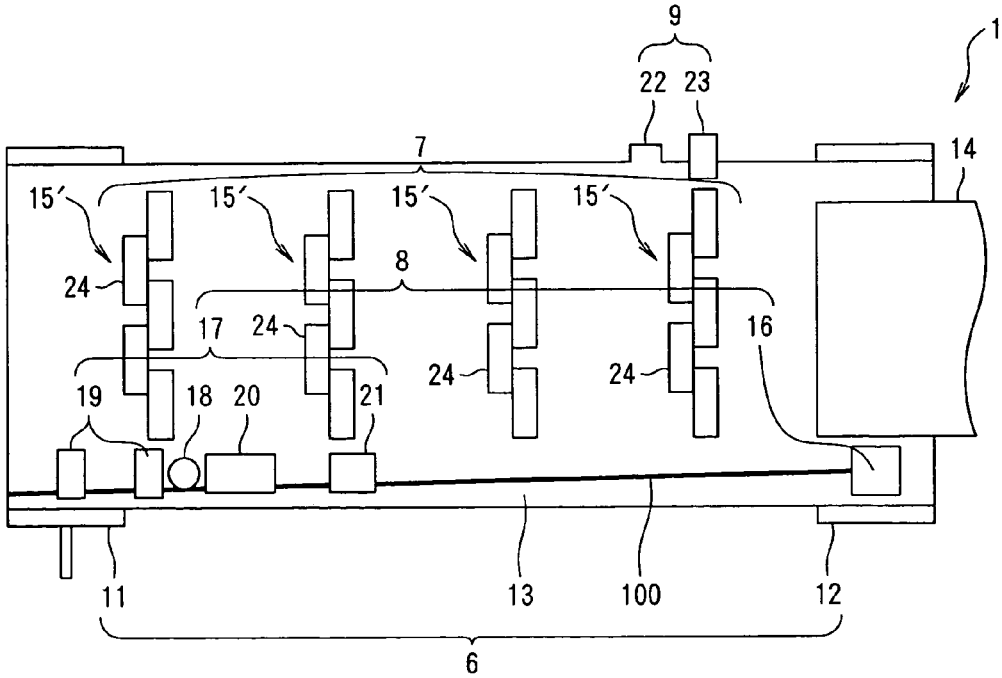

Also, although the printer heads 15 in the ink ejection portion 7 are longer than the width of the printing paper 14, this is not restrictive. For example, a plurality of sub-printer heads 24 shorter than the width of the printing paper 14 may be arranged along the width of the printing paper 14 (the width of the printer head 15) to compose a printer head 15' as shown in FIGS. 10A and 10B.

Furthermore, print data for each nozzle is shifted and thereby corrected based on meandering of the printing paper 14 so that information will be printed properly on the printing paper 14, this is not restrictive. For example, the printer heads 15 may be configured to be movable in the direction orthogonal to the paper feed direction and the printer heads 15 may be moved based on meandering of the endless belt 13 in such a way that information will be printed properly on the printing paper 14. Also, for example, the printer may be configured to check for any improper overlap between information printed by an upstream printer head 15 and information printed by a downstream printer head 15 and correct the print data to eliminate any such overlap.

The invention claimed is:

1. A printer which prints in sequence on a print medium transported by an endless belt looped over a plurality of rollers using a plurality of printer heads disposed at different locations along a transport direction of the print medium, comprising:

a data generating section which generates print data for use to make the printer heads do printing; a meander detecting section which can detect meandering of the print medium by checking for meandering of the endless belt; and a head control section which moves the printer heads based on the meandering detected by meander detecting section and the print data generated by the data generating section, wherein: the meander detecting section comprises a marking section which can place marks in predetermined locations of the endless belt; and a mark meander detecting section which can detect meandering of the endless belt right under each printer head by checking for meandering of the placed marks, and wherein: the marking section can continuously eject ink droplets to a width-direction end of the endless belt while the endless belt is rotating and the mark meander detecting section can detect meandering of the ink droplets right under each printer head while moving in the transport direction after the endless belt is stopped.

2. The printer according to claim 1, wherein: the head control section comprises a data correction section which corrects print data generated by the data generating section, based on the meandering of the print medium detected by the meander detecting section; and a printing section which makes the printer heads do printing, based on the corrected print data.

* * * * *